US005340228A

United States Patent [19]

Wilcox et al.

[11] Patent Number: 5,340,228

[45] Date of Patent: Aug. 23, 1994

[54] SELF-ADJUSTING SOFT SEAL CAP FOR FINE POINT CRAFT PAINT APPLICATORS

[75] Inventors: Reed N. Wilcox, Littleton; Richard L. George, Englewood, both of Colo.; William H. Lichfield, Corinne, Utah

[73] Assignee: The Flagship Group II, Inc., Englewood, Colo.

[21] Appl. No.: 888,059

[22] Filed: May 22, 1992

[51] Int. Cl.[5] ..... B65D 41/00

[52] U.S. Cl. ..... 401/262; 222/562; 215/319; 401/131

[58] Field of Search ..... 215/319, 342; 401/247, 401/262, 131; 222/562

[56] References Cited

U.S. PATENT DOCUMENTS

| | | | |
|---|---|---|---|
| 1,892,788 | 1/1933 | Schwartz | 222/562 |
| 2,136,033 | 11/1938 | Van Rossem | 221/60 |
| 2,249,832 | 7/1941 | Hubschman | 401/262 X |
| 2,330,183 | 9/1943 | Wolcott | 401/131 X |
| 2,893,613 | 7/1959 | Davis | 222/566 |
| 3,179,313 | 4/1965 | Maiglaive | 222/541 |
| 3,802,788 | 4/1974 | Danjczek | 401/258 X |
| 3,963,359 | 6/1976 | Anderka | 401/258 |
| 4,086,011 | 4/1978 | Kuparinen | 401/258 |
| 4,349,134 | 9/1982 | Schuster et al. | 222/562 X |
| 5,154,526 | 10/1992 | Bothe | 401/247 X |

FOREIGN PATENT DOCUMENTS

| | | | |
|---|---|---|---|
| 3906322 | 9/1989 | Fed. Rep. of Germany . | |
| 1323528 | 3/1963 | France | 401/262 |
| 1497051 | 10/1967 | France | 222/562 |
| 0670025 | 4/1952 | United Kingdom . | |

*Primary Examiner*—Steven A. Bratlie

*Attorney, Agent, or Firm*—Dorr, Carson, Sloan & Peterson

[57] ABSTRACT

For sealing a fine point applicator tip of a craft paint applicator with a cap without damage to the dispensing end of the applicator tip. The cap includes an abutment shoulder for engaging a corresponding abutment shoulder on the applicator tip to form a first seal. A flexible shoulder is formed in the interior cavity of the cap spaced from the cap abutment shoulder. The interior cavity terminates in an end wall portion spaced from the flexible shoulder. The cap is threaded onto the applicator causing the dispensing end of the applicator tip to engage the cap end wall portion. The flexible shoulder of the interior cavity of the cap resiliently yields as the dispensing end is forced against the cap end wall portion during the continued rotation of the cap until the applicator abutment shoulder engages the abutment shoulder in the cap. The cap thus seals the applicator tip in at least two positions. The resilient yielding of the flexible shoulder portion compensates for any dimensional variation in the length of the applicator tip or cap to ensure that the cap will always seal the applicator tip without damage to the tip.

1 Claim, 4 Drawing Sheets

SELF-ADJUSTING SOFT SEAL CAP FOR FINE POINT CRAFT PAINT APPLICATORS

BACKGROUND OF THE INVENTION

Related Inventions

| TITLE | SER. NO. | FILING DATE |
|---|---|---|
| Fine Point Tip Applicator for Craft Paint | 07/888,055 | May 22, 1992 |
| Inverted Cap for Craft Paint Applicators | 07/888,552 | May 22, 1992 |
| Craft Paint for Forming High Resolution Designs | 07/887,699 | May 22, 1992 |
| Craft Paint System For Forming Fine Designs and Method Therefor | 07/887,289 | May 22, 1992 |

Field of the Invention

The present invention relates to the field of craft paint applicators, and more particularly, to the field of self-adjusting soft seal caps for fine point craft paint applicators.

Statement of the Problem

There is great interest in forming stylized decorative designs on surfaces, such as fabric, wood, leather, painted, and vinyl surfaces as well as other surfaces, through the use of craft paints. Craft paints are widely used since a colorful design can be quickly created on a variety of surfaces. In craft painting, the design is not usually limited to a pattern since normally the design is painted quickly in a free hand style. The free hand style design can thus be creative and colorful. Alternatively, craft painting can be applied by the use of patterns to create a particular design.

Conventionally, craft paints are provided in applicator bottles having either tubular or conically-shaped tips. The craft paint is applied directly on the application surface from the applicator bottle through these applicator tips.

Several problems have occurred in conventional applicator bottles and caps. In order to prevent craft paint from drying out in the applicator, particularly in the applicator tip, a cap is normally screwed or snapped over the tip. However, the seal between the cap and the applicator tip or body may sometimes be insufficient to prevent air from circulating around the applicator tip. The air circulation causes the craft paint in the applicator tip to dry which then partially or fully clogs the applicator tip. This decreases the performance of the craft paint application. The dried paint restricts the flow of the craft paint out of the applicator tip as well as introducing turbulence in the flow due to obstructions created by the dried paint. This causes the flow to be irregular and more difficult to control. The restricted flow also requires increased hand pressure to force the craft paint through the restricted applicator tip which can result in the clogged flow breaking free and creating a glob or splatter of paint upon application. The problem of the tip drying is especially critical for fine tip applicators having small orifices necessary for detailed applications.

Another problem with conventional craft paint applicators occurs from inadequate sealing of the orifice of the craft paint applicator tip. Craft paint will often drain out of the applicator tip if the applicator is not maintained upright. This creates excess paint on and around the outside of the applicator tip.

Typically, in conventional craft paint applicators, the applicator tips are sealed by two basic approaches. First, an interference seal is created between the threads of the cap and the applicator bottle, and second, a friction seal is created directly against the cap by the dispensing end of the applicator tip.

The thread interference seal usually allows some air into the cap which dries the craft paint in the applicator tip and bottle. The thread interference seal tends to be ineffective to form an air-tight seal due to manufacturing tolerances in molding the plastic threads which most conventional applicators utilize.

For some applicators, a friction seal is formed by forcing the end of the tip against the inside surface of the cap so as to form a flush seal directly over the orifice. Some of these approaches use the threads as a first seal and the friction engagement as the second seal. Applicators having tubular tips generally utilize tips with relatively thick sidewalls, i.e., sidewalls greater than about 0.020 inches thick. The friction seal requires some deformation of the end surface of the tubular tip or the cap itself in order to form an effective seal. This approach is undesirable in the case of a fine precision tip (i.e., an outside diameter less than about 0.060 inches) with thin sidewalls (i.e., less than about 0.015 inches), required by the above related inventions, due to the standard dimension variations between the length of the applicator and the length of the cap. The pressure and torque necessary to form the friction seal may damage the delicate sidewalls of such a fine tip rendering it virtually useless for precision work.

Thus, a problem exists in that, at present, there is no cap for craft paint applicators which can effectively seal the craft paint applicator tip from air circulation to prevent drying of the craft paint within the applicator tip and to prevent paint leakage if the applicator bottle is tilted or inverted. This problem becomes even more critical when the applicator has a fine precision tip (i.e., less than about 0.060 inches in outside diameter) with thin sidewalls (i.e., less than about 0.015 inches thick) for use in applying craft paint in fine and detailed patterns. In order to provide an elegant look to the painted design, particularly when uniform three dimensional discrete beads of craft paint are closely spaced together, the craft paint must be applied in a precise and uniform fashion. This is not possible with clogged and/or damaged conventional applicator tips. A need, therefore, exists for a fine point craft paint applicator which fully seals the orifice of the tip from air and from leakage while fully maintaining the physical integrity of the fine point.

Solution to the Problem

The present invention solves the above identified problems and others by providing a self-adjusting soft seal cap for craft paint, fine point applicators. The present invention substantially prevents air from circulating around the applicator tip and further prevents paint leakage regardless of the orientation of the applicator without damaging the fine point.

The cap of the present invention provides a novel multi-seal design for sealing craft paint applicators to prevent drying and leakage of the craft paint in the applicator tip and bottle while preventing damage to the fine point.

The present invention provides a cap for fine point craft paint applicators which self-adjusts for dimensional variations in the effective length of the applicator tip with respect to the neck of the applicator bottle due to dimensional tolerances occurring in the manufacturing process. The self-adjusting cap effectively seals the applicator tip, without damage to the tip, from air circulation and paint leakage. This effectively prevents drying of the craft paint within the applicator tip, even when the length of the dispensing end of the applicator tip or the length of the neck portion of the applicator bottle varies because of manufacturing tolerances.

The cap of the present invention, therefore, self-adjusts to compensate for variations in the length of the applicator tip and in the length of the neck of the applicator bottle to provide a friction seal over the orifice or dispensing end of the fine point without damaging the applicator tip.

The cap of the present invention further provides a soft seal on the applicator tip to seal the applicator tip from air circulation and drainage without damaging the applicator tip.

The present invention further provides a cap which seals the craft paint applicator tip in multiple positions to minimize air circulation around the applicator tip.

The cap of the present invention effectively seals the applicator tip from air circulation and drainage regardless of the orientation of the applicator.

These and other features of the present invention will be evident in the ensuing drawings and description.

SUMMARY OF THE INVENTION

The present invention provides a cap for fluid applicators and particularly for craft paint applicators having fine tips. The cap of the present invention will self-adjust for dimensional variations in the length of the applicator tip and/or in the length of the neck of the applicator bottle. This provides a friction seal over the orifice of the fine point without damaging the applicator tip. The self-adjusting cap ensures effective friction sealing of the dispensing end of the applicator tip to prevent drying and clogging within the applicator tip. Also, the self-adjusting cap prevents leakage of the craft paint from the dispensing end of the applicator tip when the applicator is tilted or inverted.

The cap of the present invention, in the preferred embodiment, includes an interior cavity having threads for engaging threads on the neck portion of the applicator bottle. This forms a conventional interference seal.

An abutment shoulder is additionally formed upwardly adjacent to the cap threads for engaging an opposing abutment shoulder on the applicator bottle to form an additional first seal of the present invention. These abutment shoulders also act as a stop or limit to prevent damage to the applicator tip.

A flexible shoulder portion or accordion is formed on the sidewalls in the interior cavity of the cap spaced upwardly from the cap abutment shoulder. The interior cavity of the cap terminates in an end wall portion at the top of the closed end of the cap. When the cap is threaded onto the applicator, the orifice end of the applicator tip engages the end wall portion. The flexible shoulder first resiliently yields from pressure of the dispensing end against the end wall portion for about 0.010 inches. The shoulder then yields from the pressure caused by the engagement of the abutment shoulder of the applicator tip against the flexible shoulder itself as the cap is further threaded onto the applicator. The flexible shoulder allows the interior cavity of the cap to elongate until the applicator tip abutment shoulder engages the abutment shoulder in the cap which stops further threading.

The cap of the present invention thus seals the applicator tip in four locations. The threads of the cap and applicator form a conventional frictional seal. An additional seal is formed from the engagement of the abutment shoulder of the cap with the abutment shoulder of the applicator tip which minimizes air circulation around the applicator tip. A conventional friction seal is formed from the engagement of the orifice or dispensing end of the applicator tip with the inner end wall portion of the cap which prevents air from circulating into the orifice and which prevents craft paint from leaking out of the orifice. The resilient yielding of the flexible shoulder portion provided by the present invention compensates for any dimensional variation in the length of the applicator tip and/or in the length of the cap to ensure that the cap will frictionally seal the applicator tip even when such dimensional variations are present. The resilient yielding of the flexible portion of the present invention minimizes damage to the fine point of the applicator tip while forming an effective friction seal against the dispensing end. The flexible shoulder portion also engages a surface on the applicator tip to create an additional seal of the present invention to further minimize any air circulation around the applicator tip.

Thus, four effective seals are provided by the cap of the present invention: a first seal provided by an abutment shoulder on the applicator; a second seal between the dispensing or orifice end and the cap which self-adjusts to dimensional variations of the cap and applicator; a third seal provided by the flexible shoulder or accordion on the cap engaging the applicator tip; and a fourth seal provided by the threads. A novel self-adjusting soft seal cap is provided for preserving the physical integrity of the orifice of the fine point applicator tip while substantially eliminating leakage and air drying of the point.

BRIEF DESCRIPTION OF THE DRAWINGS

FIG. 4(*b*) is a detailed cut-away view of a variation of the prior art cap of FIG. 3.

FIG. 6(*b*) is a detailed view of the cap of the present invention fully engaged on an applicator tip of the present invention.

DETAILED DESCRIPTION OF A PREFERRED EMBODIMENT

Overview Of Environment of Use

The present invention provides a new cap design for fluid applicators such as craft paint applicators and a new fine point applicator tip design. The preferred embodiment of the present invention describes a self-adjusting, soft sealing cap for a fine point craft paint applicator used in creating stylized decorative designs on a surface. Uniform three dimensional discrete beads closely spaced together are applied by the applicator to form a color dot matrix pattern that visually merges to form solid lines or fields of color having a high degree of resolution and color saturation.

Figure 1:
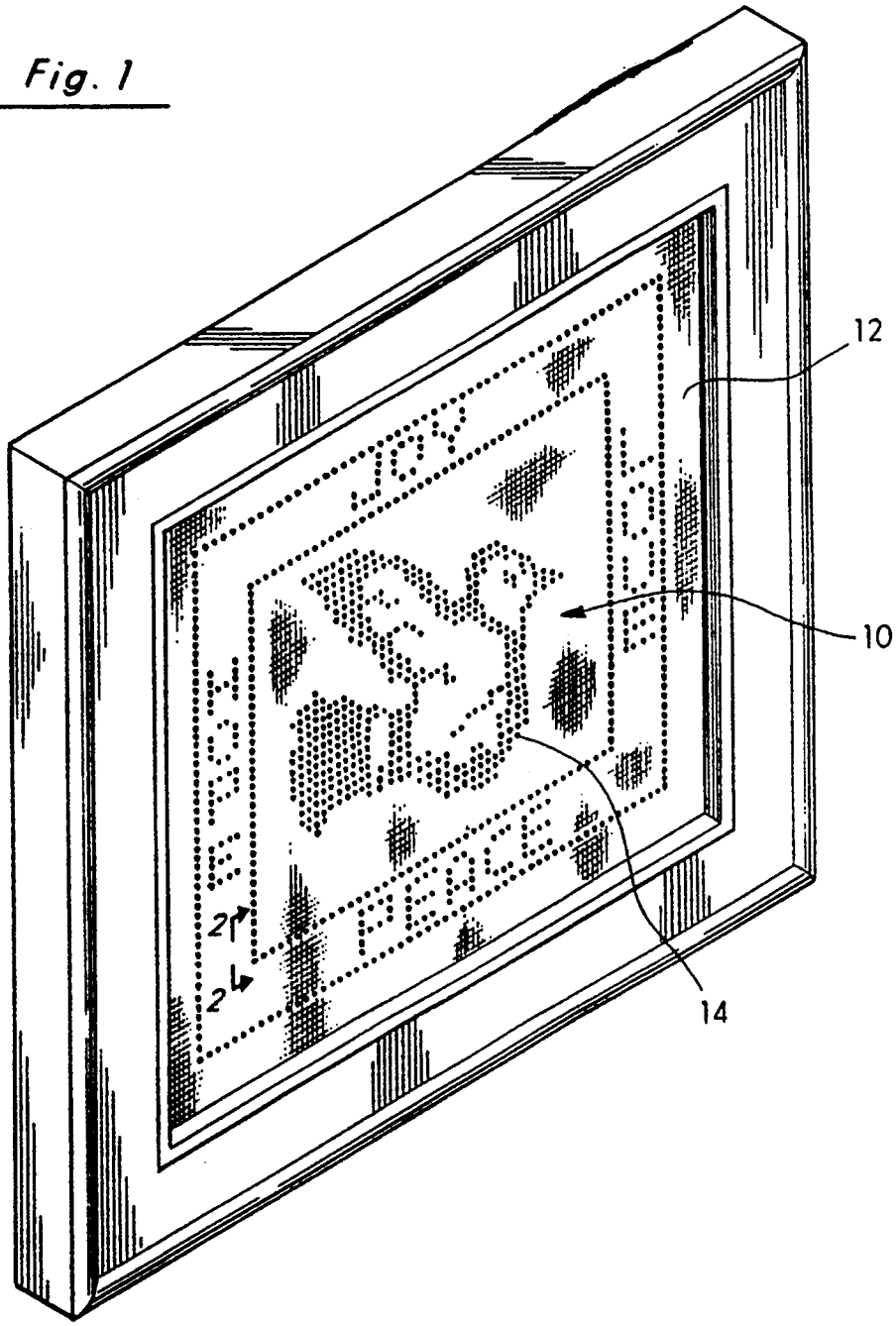
FIG. 1 illustrates a design created by the use of a fine point craft paint applicator on which the cap of the present invention has utility.
Figure 2:
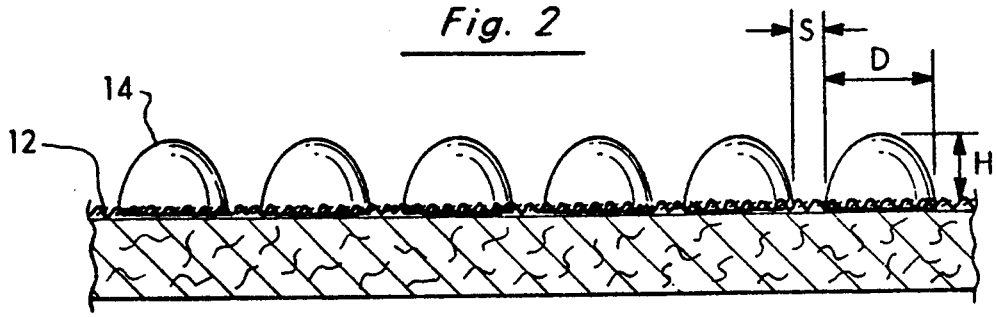
FIG. 2 is a cross-sectional view of the detail of a portion of the design of FIG. 1.

One such design 10 is illustrated in FIG. 1. Design 10 is created on a fabric surface 12 by a plurality of beads 14 of differing colors. Each bead 14 has a uniform homogeneous shape, as shown in FIG. 2, to provide a dimensional, textured appearance. The term "uniform" as used herein refers to beads 14 having a regular size and a smooth, substantially rounded, spherical shape. A fine applicator tip is required in order to create the beads shown in FIG. 2.

An airtight seal of the applicator fine tip is necessary to prevent drying in, and clogging of, the tip. If the paint dries in the dispensing end, the inner orifice of the fine tip applicator becomes restricted which affects the formation of the beads. For example, if paint should dry in the dispensing end of the applicator tip and partially clog it, the craft paint may require more pressure on the bottle for dispensing which may then cause the dry paint to suddenly spit out, spatter or glob, and ruin the design. One such mistake, in such fine work, becomes readily identifiable by a viewer causing the entire work to be ruined. Further, a restricted applicator tip may create undesirable turbulent flow which produces an irregular flow, again causing difficulty in forming the uniform discrete beads needed to create finely detailed applications.

To create such uniform beads, it is also critical that the fine point not be damaged by the cap when sealing the dispensing end. Damage to the dispensing end of the tip dramatically affects the ability of the user to apply uniform beads of paint. Hence, the present invention provides a self-adjusting seal or soft seal so as to prevent damage to the fine tip upon sealing against the cap. Finally, the seal of the present invention prevents paint leakage upon tilting or inversion of the applicator.

It is to be expressly understood that the sealing cap of the present invention is not limited to the descriptive environment of use set forth in FIGS. 1 and 2. The sealing cap of the present invention includes other applications and embodiments within the scope of the present inventive concept.

Prior Art Approaches

Figure 3:
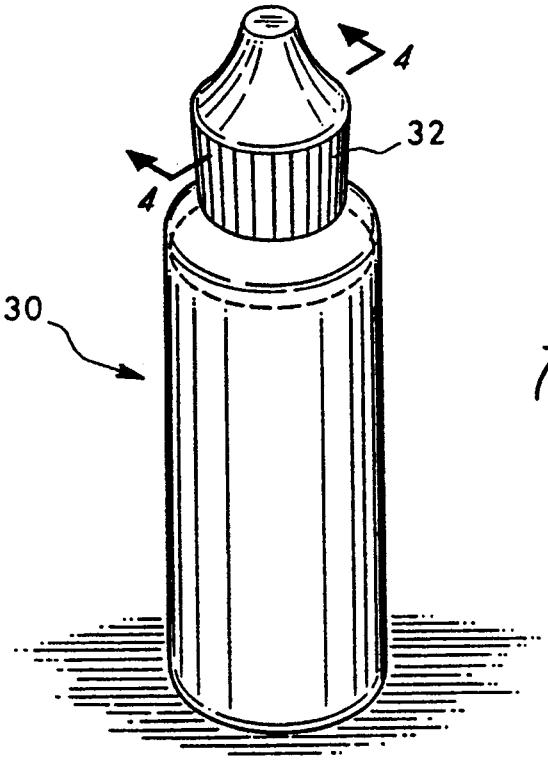
Fig. 3 (Prior Art)
FIG. 3 is view of a prior art sealing cap for a craft paint applicator.
Figure 4B:
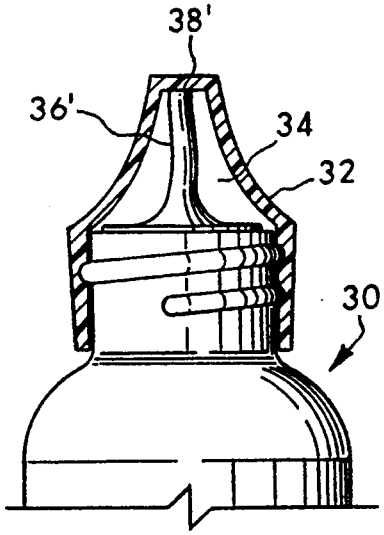
Fig. 4(b) (Prior Art)
FIG. 4(*a*) is a detailed cut-away view of the prior art cap of FIG. 3.
Figure 4A:
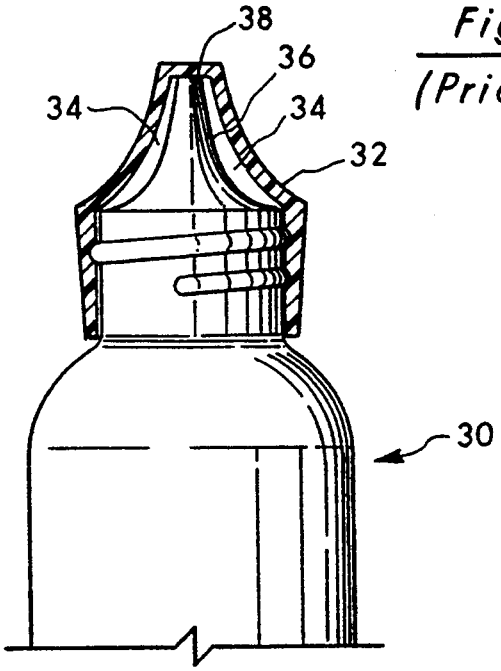
Fig. 4(a) (Prior Art)

FIG. 3 illustrates a typical prior art craft paint applicator bottle 30 having a cap 32 for sealing the applicator tip (not shown). This prior art sealing cap 32, as shown in FIG. 4 (*a*), is normally threaded onto applicator bottle 30 to form a friction seal 34 on the applicator tip 36. The tip 36 shown in FIG. 4(*a*) is a conical tip with thick sidewalls and the dispensing end 38 frictionally engages the cap to form a seal.

Another type of craft paint applicator tip 36', shown in FIG. 4(*b*), is of tubular shape with dispensing end 38'. Cap 32 is tightened onto applicator 30 until the inner wall of cap 32 forms a friction seal flush against dispensing end 38'. Fine tip applicators having thin sidewalls are easily damaged by the force of cap 32 tightened against the dispensing end, especially in the presence of dimensional variations. For example, the dispensing end 38' can be squashed and/or the tip bent off to one direction. Since the effective length of the applicator tip frequently varies due to manufacturing tolerances of either the cap or the application tip, sealing fine tip applicators can be a problem. Air may circulate around the dispensing end of the applicator tip causing the craft paint in and around the dispensing tip to dry and clog the orifice. Also, the craft paint in the applicator bottle may drain out of the dispensing end into the cap if the applicator bottle is tilted or inverted.

Structure of Present Invention

Figure 5:
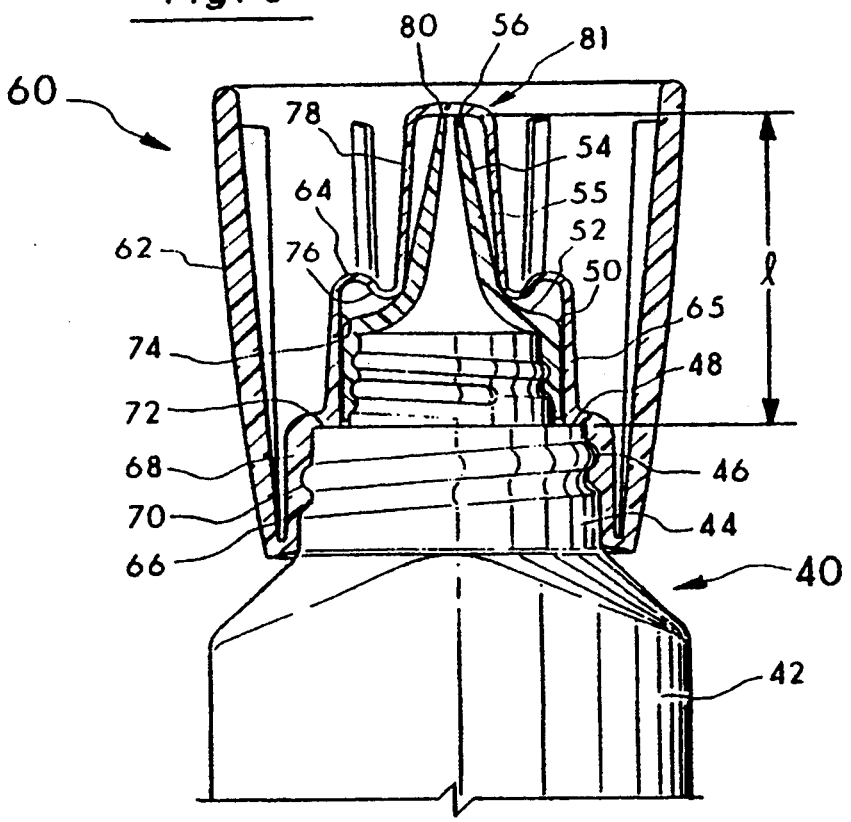
FIG. 5 is a cross-sectional view of the cap and applicator tip of the present invention.

The present invention provides a self-adjusting, soft seal cap for a fine tip craft paint applicator. The soft seal cap not only prevents air from circulating around the dispensing end of the applicator tip but also seals the dispensing end from drainage and drying without damaging the dispensing end. A preferred embodiment of the cap 60 of the present invention is illustrated in FIG. 5. A typical applicator 40 is also shown.

Applicator 40 includes applicator bottle 42 with reduced portion or neck 44 on which threads 46 are formed for a cap to be attached thereon. Shoulder 48 is formed between neck 44 and applicator tip 50. Applicator tip 50 includes a substantially conical tip 54 with surface 55 extending from region 52 to a dispensing end 56 from which the craft paint is dispensed. The outside diameter of the end 56 is less than about 0.060 inches and the corresponding sidewall thickness is less than about 0.015 inches.

Cap 60 is used to seal applicator tip 50 of applicator 40. It is to be expressly understood that the descriptive embodiment of cap 60 discussed herewith is for explanatory purposes only and is not meant to limit the scope of the present inventive concept. Cap 60 includes an exterior portion 62 and an interior portion 64. Exterior portion 62, for purposes of the present invention, can be of any preferred shape and design and does not form a part of the present invention. Interior portion 64 provides a plurality of seals for sealing applicator tip 50 as discussed below.

Interior portion 64 includes an interior cavity 66, formed by sidewalls 65 and closed end 81, having a first substantially cylindrical portion 68 with female threads 70 for engagement with male threads 46 of applicator bottle 42.

The threads 70 and 46 are designed for a quick connection in about a twist and a half. A second cylindrical portion 74 having a smaller diameter than cylindrical portion 68 upwardly adjacent to the end of threaded portion 70 terminates at shoulder 72. Shoulder 72 creates an abutment surface. As threads 70 of cap 60 engage threads 46 of applicator 40, shoulder 48 on applicator bottle 42 abuts shoulder portion 72 of cap 60. The abutment between shoulder portion 48 of applicator bottle 42 and shoulder portion 72 of cap 60 forms the first seal of the present invention to prevent air that may pass through threads 46 and 70 from circulating around applicator tip 50. This first seal also functions to provide a "stop" or "limit" as to how far the cap can be screwed onto the applicator 40. This prevents overtightening of the cap and possible damage to the fine point. While the preferred embodiment of FIG. 5 shows the first seal to be just above the threads it could be oriented higher on cylinder 74.

A third substantially conical shaped portion 78 of interior cavity 66 of cap 60 tapers inward to terminate in end wall portion 80 of closed end 81. Third portion 78, which is of a smaller diameter than second portion 74, terminates in a flexible shoulder 76, which is positioned between the second portion 74 and the third portion 78. Flexible shoulder 76 includes an S-wall or accordion-shape to form a resilient shoulder which is expandable to provide a soft seal on dispensing end 56 of applicator tip 50, as discussed in detail below. Flexible shoulder portion 76 is formed from the same material as the cap 60 but is flexible because of its shape and thinner sidewalls. The interior portion 64 is designed to provide sufficient give to permit the dispensing end 56 to push up on the closed end 81 without causing damage to the fine tip.

In the preferred embodiment, flexible shoulder 76 has a reduced sidewall thickness relative to the remainder of cap 60. In this embodiment, flexible shoulder 76 is designed always to expand resiliently at least about 0.007 inches and preferably expands in the range of about 0.010 to 0.015 inches.

Tapered portion 78 extends from flexible shoulder 76 and tapers inward as shown in FIG. 5 to terminate in end wall 80 of the closed cap end 81. End wall 80 engages dispensing end 56 of applicator tip 50 to provide the second seal of the present invention to seal the dispensing end 56. This prevents air from circulating within the applicator tip and prevents craft paint within applicator bottle 42 from leaking out of dispensing end 56 if the applicator bottle 42 is tilted or inverted.

Cap 60 is able to self-adjust by means of flexible shoulder 76 to compensate for dimensional variations in the effective length "1" of applicator tip 50 to ensure that the applicator tip is always sealed. The effective length "1" of applicator tip 50 is defined by the distance between dispensing end 56 and the shoulder 48. The effective length "1" can vary due to dimensional variations or tolerances in molding the applicator tip and the cap. There may also be dimensional variations of the cap over the length "1" (i.e., from shoulder 72 to end 80). Flexible shoulder 76 provides an expandable feature to compensate for differences in length "1" of applicator tip 50 without damaging dispensing end 56 (i.e., soft seal). In the preferred embodiment, the effective length "1" is about 1.5 inches.

Self-Adjusting Operation

Figure 6A:
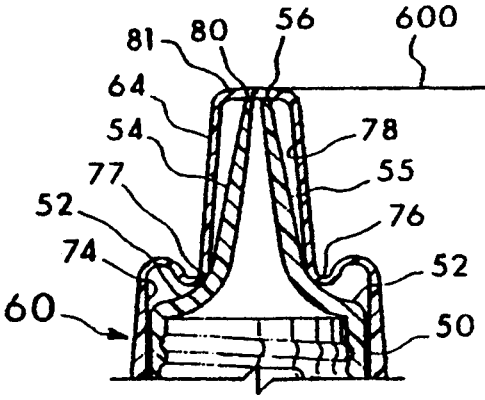
FIG. 6(*a*) is a detailed view of the cap and applicator tip of the present invention.
Figure 6B:
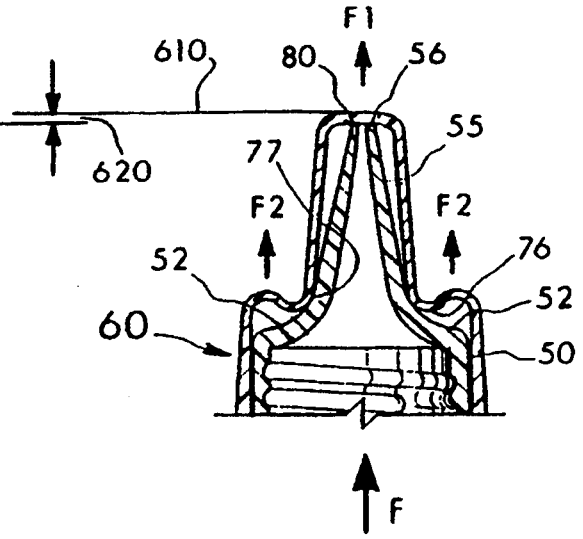

The self-adjusting feature of the cap also provides the third seal of the present invention as illustrated in FIGS. 6(*a*) and 6(*b*). FIG. 6(*a*) shows applicator tip 50 and the interior wall 74 of cap 60 upon initial engagement of the cap. Flexible shoulder 76 is in an unbiased position. This initial position includes spacing between shoulders 48 and 72. In this initial position, the flexible shoulder 76 is not biased and the closed end 81 is at line 600. In the preferred embodiment, the length between shoulder surface 52 of applicator tip 50 and dispensing end 56 is controlled to about 0.001 of an inch in the molding process. This provides an additional measure to minimize damage to dispensing end 56 due to dimensional variations. Variations in the effective length "1" of the applicator tip typically occur due to manufacturing tolerances of the neck portion 44 of the applicator bottle 42 and from the attachment of the applicator tip 50 on applicator neck portion 44.

As the applicator cap 60 is attached over applicator tip 50 by the further engagement of threads 70 with threads 46 of the applicator, applicator dispensing end 56, as shown by arrow F1 in FIG. 6(*b*), abuts end wall 80 and pushes against end wall 80. This occurs for only a slight distance to ensure an effective seal occurs on dispensing end 56. Surface 77 abuts against surface 52 to cause flexible shoulder 76 to yield, as shown by arrows F2 in FIG. 6(*b*). When the cap is fully on over the tip, a distance 620 of movement has occurred. Dispensing end 56 is effectively soft-sealed at this juncture to prevent damage to the tip. Applicator tip surface 52 engages surface 77-with force F2 to cause the interior cavity of cap 60 to elongate until shoulder portion 48 of the applicator tip abuts shoulder portion 72 of cap 60 to form the aforesaid first seal.

FIG. 6(*b*) illustrates an important feature of the present invention. The expansion of the closed end 80 to a new position 610 occurs as a result of two upward forces F1 and F2. The user applies force F to twist cap 60 onto tip 50. Forces F1 and F2 combine to equal F. The upward force F2 reduces the force F1 so as to minimize any damage to the fine point. While this is a preferred embodiment, it is to be understood that certain designs may use only force F1 in which case F would equal Fl.

The flexible shoulder 76 or accordion is designed to adjust to compensate for dimensional variations in either the tip 50 or the cap 60 as discussed above. For a first example, if the tip is "shorter" due to a "minus" dimensional variation and the cap is "longer" due to a "plus" dimensional variation, then in FIG. 6(*b*) the distance 620 would be small. In which case, the end 56 would form a soft seal with surface 80 and there would be only slight movement of flexible shoulder 76 (i.e., a small self-adjustment). In the preferred embodiment, a distance 620 of at least 0.007 inches is always obtained. For a second example, if the tip is "longer" due to a "plus" dimensional variation and the cap is "shorter" due to a "minus" variation, then in FIG. 6(*b*) the distance 620 would be larger. In which case, the end 56 would still form a soft seal with surface 80, but there would be significant movement of flexible shoulder 76.

In the preferred embodiment a range of about 0.010 to 0.015 inches is utilized during expansion. Importantly, during the range of movement of flexible shoulder 76 (distance 620), the soft seal created provides substantially a soft sealing force on dispensing end 56. This sealing force is sufficiently low in order to prevent damage on the thin sidewalls of the dispensing end. If the flexible shoulder 76 were not present, the dimensional variations in the second example presented above would cause the end 56 to deform upon tightening as shown in FIG. 4(*b*). The flexible shoulder 76 provides significant relief to prevent deformation while maintaining a fluid seal.

The flexible shoulder 76 ensures sealing of the applicator tip in at least two positions, in addition to the conventional threaded interference seal, to prevent air circulation around the dispensing end and to prevent craft paint from draining out of the applicator tip. The contact between surface 77 and surface 52 of applicator tip 50 reduces the pressure against dispensing end 56 to minimize damage to dispensing end 56. The contact at surfaces 52 and 77 also creates an additional third seal to further prevent air circulation around the applicator tip.

It is to be expressly understood that the above description of a preferred embodiment of a sealing cap is intended for explanatory purposes only. Other variations and embodiments are considered to be within the scope of the present inventive concept. For instance, an accordion-like or bellows-like structure can be formed at other locations on the applicator tip in order to allow expansion to compensate for variations in the effective length of the applicator tip.

Figure 7:
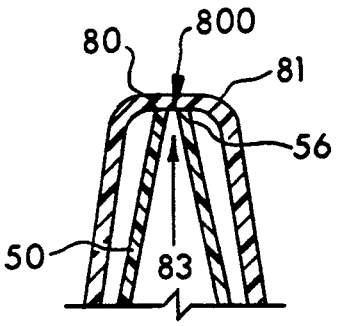
FIG. 7 is a detailed cross-section of the soft seal of the present invention.

Flexible shoulder 76 provides a "soft" seal 800 between dispensing end 56 and end wall 80 as shown in FIG. 7, regardless of dimensional variations in the length of the applicator tip or cap, without damaging the fine point applicator tip 56. Dispensing end 56 engages against a substantially flat surface on end wall 80. This allows the load to be spread evenly over the surface diameter portion of the dispensing end which minimizes damage to the tip. This soft seal 800 is effective in preventing air from circulating into orifice 83 which would cause the paint to dry on and in the orifice as well as preventing any leakage of the craft paint from the orifice into the cap. In the preferred embodiment, the orifice 83 has an outside diameter at end 80 less than about 0.060 inches with a sidewall thickness less than about 0.015 inches.

In summary, applicator tip 50 is effectively sealed from air circulation by: (1) the engagement of shoulder portion 48 of the applicator tip with shoulder portion 72 of the cap, (2) the engagement of dispensing end 56 with end wall portion 80, (3) the engagement of applicator tip surface 52 with flexible shoulder surface 77, and (4) an interference seal between threaded portion 46 of the applicator tip with threaded portion 70 of the cap.

Second Preferred Soft Seal Embodiment

Figure 8:
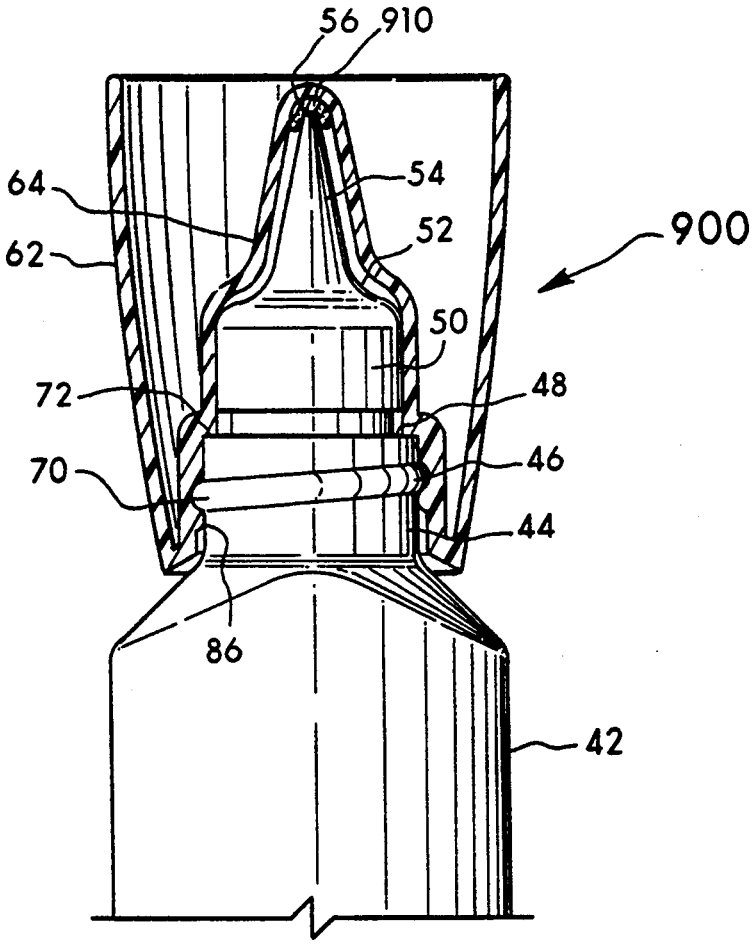
FIG. 8 is a cross-sectional view of a second preferred embodiment of the present invention.

A second preferred embodiment of a soft seal cap of the present invention is illustrated in FIG. 8. Applicator tip 50 is similar to the applicator tip discussed above. Cap 900 includes an exterior portion 62 and an interior portion 64, similar to the design of the above discussed embodiment. Threads 70 in interior cavity 86 of cap 900 engage threads 46 on neck 44 of applicator bottle 42. Abutment shoulder 72 on cap 900 engages abutment shoulder 48 of neck portion 44 to form a first seal.

Cap 900 differs from the earlier described embodiment in that there is no flexible shoulder portion on cap 900. Instead, a soft resilient member 910 is mounted in the inner wall portion of cap 900. Member 910 can be a sponge-like material, a soft plastic bubble-like structure, or other soft resilient structures. As cap 900 is secured onto applicator 40, dispensing end 56 of applicator 40 engages member 910 to form a soft seal against dispensing end 56. Dispensing end 56 is pressured into member 910 which absorbs the impact without damaging dispensing end 56 until shoulder 72 engages abutment shoulder 48 to form the aforesaid first seal. Thus, an effective soft seal is created without damaging the dispensing end of the applicator tip regardless of dimensional variations in the effective length of the applicator tip and/or cap.

The soft seal cap of the present invention provides a positive seal between the cap and an applicator tip not only along the sides of the applicator tip but also against the dispensing end of the applicator tip to further minimize the introduction of any air around the applicator tip. Accidental leakage of the fluid within the applicator out of the dispensing end is prevented as well, by the soft seal cap. These features are ensured regardless of dimensional variations in the length of the applicator tip due to the flexible portion of the soft seal cap which will self-adjust to compensate for any variations without damaging either the applicator tip or the cap.

The present invention is not meant to be limited by the description of the above exemplary embodiment. The configuration of the cap of the present invention encompasses other embodiments and variations as well as being applied in a number of differing applications within the scope of the present inventive concept.

We claim:

1. A fine tip applicator system for dispensing craft paint, said fine tip applicator system comprises:

a container for holding craft paint, said container including:

(a) attaching means formed on said container; and (b) a container abutment shoulder formed on said container;

an applicator tip affixed on said container for dispensing said craft paint; said applicator tip including:

(a) an elongated portion spaced from said container abutment shoulder; and (b) a dispensing end formed on the end of said elongated portion of said applicator tip, said dispensing end having an outside diameter less than 0.060 inches with a thin sidewall having a thickness of less than about 0.015 inches through which the craft paint is dispensed from said container; and a cap for attachment over said applicator tip onto said container for sealing said applicator tip to minimize air circulation around said applicator tip and to prevent drainage of the craft paint out of said dispensing end; said cap including:

(a) means on said cap for securing said cap to said attaching means of said container;

(b) an interior cavity;

(c) a reduced diametrical portion forming a cap abutment shoulder in said interior cavity for engaging said container abutment shoulder to form a first seal between said cap and said applicator tip when said cap is fully attached over said applicator tip;

(d) an end wall formed in said interior cavity for engaging said dispensing end to form a second seal between said applicator tip and said cap when said cap is fully attached over said applicator tip; and (e) flexible means formed in said interior cavity between said cap abutment shoulder and said end wall for resiliently yielding, in the range of about 0.005 to 0.015 inches, as said dispensing end of said applicator tip engages said end wall until said container shoulder engages said cap abutment shoulder to form said first seal and said second seal when said cap is attached to said applicator tip; said flexible means compensating for dimensional variations of said cap and said applicator tip so as to form said second seal with minimal damage to said dispensing end, said flexible means including a second reduced diametrical portion formed in said interior cavity between said cap abutment shoulder and said end wall forming a flexible shoulder which allows said interior cavity to elongate (1) as said dispensing end of said applicator tip engages said cap end wall and (2) as a side surface on said applicator tip engages said flexible shoulder to compensate for dimensional variations in the length of said applicator tip to ensure said container abutment shoulder engages said cap abutment shoulder without damaging said dispensing end, said side surface forming a third seal with said flexible shoulder;

said means for securing on said cap comprises a threaded portion and said attaching means on said container comprises a threaded portion for mating engagement so as to form a fourth seal.

* * * * *